US005474288A

United States Patent [19]

Lo et al.

[11] Patent Number: 5,474,288

[45] Date of Patent: Dec. 12, 1995

[54] SHEET FEEDER FOR COMPUTER PRINTER WITH PAPER RELEASE DRAG REDUCTION TO LENGTHEN LIFE OF PRINTER SHEET INPUT ROLLERS

[76] Inventors: Thomas Y.-C. Lo, 820 Optimo Ave., Fremont, Calif. 94539; Robert B. Gerstenberger, 21651 Gail Dr., Castro Valley, Calif. 94546

[21] Appl. No.: 279,249

[22] Filed: Jul. 21, 1994

Related U.S. Application Data

[63] Continuation-in-part of Ser. No. 279,250, Jul. 21, 1994.

[51] Int. Cl.[6] ..... B65H 5/00

[52] U.S. Cl. ..... 271/110; 271/118; 271/126; 271/155

[58] Field of Search ..... 271/10, 22, 24, 271/25, 110, 111, 117, 118, 126, 152, 153, 155, 154, 147, 2

[56] References Cited

U.S. PATENT DOCUMENTS

| | | | |
|---|---|---|---|
| 3,981,493 | 9/1976 | Klappenecket et al. | 271/10 |
| 4,702,466 | 10/1987 | Dubois | 271/10 |
| 4,925,177 | 5/1990 | Nakamura et al. | 271/110 |
| 5,090,675 | 2/1992 | Nagai et al. | 271/110 |
| 5,386,982 | 2/1995 | Kawano | 271/10 |

*Primary Examiner*—H. Grant Skaggs

*Attorney, Agent, or Firm*—Ronald C. Fish; Falk, Vestal & Fish

[57] ABSTRACT

A control system for a host device sheet feeder that lengthens the life of the input feed roller of the host device by reducing drag on the sheet of paper being dragged into the host device by the feed roller thereof. Drag is reduced by sensing when a sheet of paper has been pushed far enough into the paper path to be close to engagement with the input feed roller of the host device. Then the control system pushes the sheet of paper a predetermined distance further until it engages with or is about to be engaged with the host device feed roller and starts being drawn into the host device. When the sheet of paper has travelled the predetermined distance, the control system drops a movable floor of the paper magazine of the sheet feeder sufficiently to take the top sheet of paper out of contact with the feed roller of the sheet feeder. This reduces or eliminates the drag associated with pinching of the top sheet of paper between the feed roller of the sheet feeder and the next sheet of paper down in the stack. In an alternative embodiment, the feed roller of the sheet feeder can be selectively raised so as to be out of contact with the back end of the sheet of paper being drawn into the host device to eliminate drag after the sheet has been engaged by the feed roller of the host device.

7 Claims, 4 Drawing Sheets

SHEET FEEDER FOR COMPUTER PRINTER WITH PAPER RELEASE DRAG REDUCTION TO LENGTHEN LIFE OF PRINTER SHEET INPUT ROLLERS

BACKGROUND OF THE INVENTION

This is a continuation-in-part of a prior U.S. patent application entitled " HIGH CAPACITY, LOW JAM ENVELOPE FEED FOR LASER PRINTER", having Ser. No. 08/279,250 filed Jul. 21, 1994 the details of which are hereby incorporated by reference. The invention pertains to the field of sheet feeders for any device which needs the input of paper or other media such as computer printers, photocopiers or collators. More specifically, the invention pertains to the field of improvements in sheet feeders to selectively reduce the amount of drag imposed by the sheet feeder on a sheet being drawn into the host device thereby simplifying the design of the host. An significant advantage in at least the laser printer field is the increase in the lifespan of the feed roller(s) at the paper input port of the laser printer.

Conventional sheet feeders for laser printers utilize an enclosed magazine with a movable bottom. The magazine holds multiple sheets of paper which are fed from the top one sheet at a time into the input port of a laser printer. The movable bottom is driven by a stepper motor under the control of a microprocessor so as to move upward as sheets are fed into the laser printer. This maintain the current top sheet of paper in contact with a feed roller of the sheet feeder. The sheet feeder's feed roller is spring loaded so as to bear down on the top sheet paper with sufficient normal force such that the frictional force between the feed roller and the top sheet of paper tending to move the paper sheet toward the printer exceeds the frictional force between the top sheet of paper and the second sheet of paper tending to keep the top sheet of paper from moving toward the printer. The microprocessor controls the stepper motor that drives the movable bottom of the sheet feeder in such a manner that the top sheet of paper is placed in a position so as to push the sheet feeder input feed roller upward against the bias of its spring.

The sheet feeder's input feed roller moves the top sheet of paper toward the laser printer by frictional engagement between the rubber of the feed roller and the top sheet of paper when the feed roller is rotated in the proper direction. The feed roller is driven by a stepper motor under control of a microprocessor in the sheet feeder. The feed roller is driven so as to drive the top sheet of paper into the printer either when the last sheet of paper fed into the laser printer clears sheet feeder's paper feed path, or, in alternative embodiments, when the laser printer signals that it needs another sheet of paper. Such prior art sheet feeders are exemplified by the 1500 sheet feeder currently commercially available from Genesis Technology in Hayward, Calif., the details of which are hereby incorporated by reference.

The problem with prior art sheet feeders of the aforementioned design is excessive wear that can occur on the input feed roller of the laser printer that pulls the paper sheet into the printer after the feed roller of the sheet feeder feeds the top sheet far enough into the laser printer to engage with the input feed roller of the printer. That is, when the input feed roller of the laser printer starts to roll to draw the top sheet into the laser printer, the back end of the top sheet of paper is still pinched between the feed roller of the sheet feeder and the next sheet down in the stack. This causes additional drag on the sheet as the feed roller of the laser printer tries to pull the sheet in. This additional drag can cause slippage between the laser printer input feed roller and the sheet of paper being drawn into the printer. It is this slippage which substantially shortens the useful life of the laser printer input feed roller. Some prior art sheet feeders have tried to solve this problem mechanically by using a cam mechanism to move the floor of the sheet feeder downward when the feed roller of the laser printer engages the top sheet. This reduces the drag on the top sheet, but it requires additional components to selectively engage the cam at the right time etc. Further, with very large capacity sheet feeders such as the Genesis 1500 sheet feeder, the cam mechanism requires a great deal of power to move the large mass of paper in the magazine up and down each time a sheet is fed. This requires a large motor and unnecessarily adds to the weight and cost of such a sheet feeder.

Accordingly, a need has arisen for a sheet feeder for a laser printer which can reduce the drag on sheets of paper being drawn into a laser printer so as to not reduce the useful life of the rollers of the laser printer without substantially adding to the cost or weight of the sheet feeder.

SUMMARY OF THE INVENTION

According to the teachings of the invention, there is disclosed herein a sheet feeder for a laser printer which includes software controlling the operations of the sheet feeder microprocessor so as to drive the motor controlling the movable bottom of the sheet magazine in a way to reduce the aforementioned drag which causes excess wear. This is done by monitoring the switch state of a paper sensor in the paper feed path of the sheet feeder for the presence of a sheet of paper in position to be drawn in by the input feed roller of the laser printer. Once the sensor senses paper in this position, by advancing the paper slightly further, the paper will be engaged by the input feed roller of the laser printer and will start to be drawn into the laser printer. Before or just as the feed rollers of the laser print start to move to draw the paper in, the microprocessor of the sheet feeder commands the motor driving the movable floor to drop the floor slightly so as to eliminate or substantially reduce friction between the sheet in position to be drawn into the laser printer and the feed roller(s) of the sheet feeder. This substantially reduces the drag on the paper being pulled in by the feed rollers of the laser printer thereby extending the life of the input feed roller of the laser printer.

After the sheet of paper has been drawn into the laser printer, the paper sensor in the paper path changes states. This causes the microprocessor to command the motor driving the movable floor to move the floor back up toward the feed roller. The movement must be sufficient to cause the new top sheet of the stack to come into contact with the feed roller of the sheet feeder and to compress the bias springs sufficiently. The bias springs must be compressed (or stretched in embodiments with different mechanical configurations) enough to cause the feed roller of the sheet feeder to bear down on the stack with a predetermined normal force. This normal force must be large enough to cause the forces imposed upon the top sheet in the stack by the feed roller to be sufficient to separate the top sheet from the next sheet down in the stack when the feed roller rolls so as to push the top sheet into the paper feed path.

DETAILED DESCRIPTION OF THE PREFERRED EMBODIMENT

Figure 1:
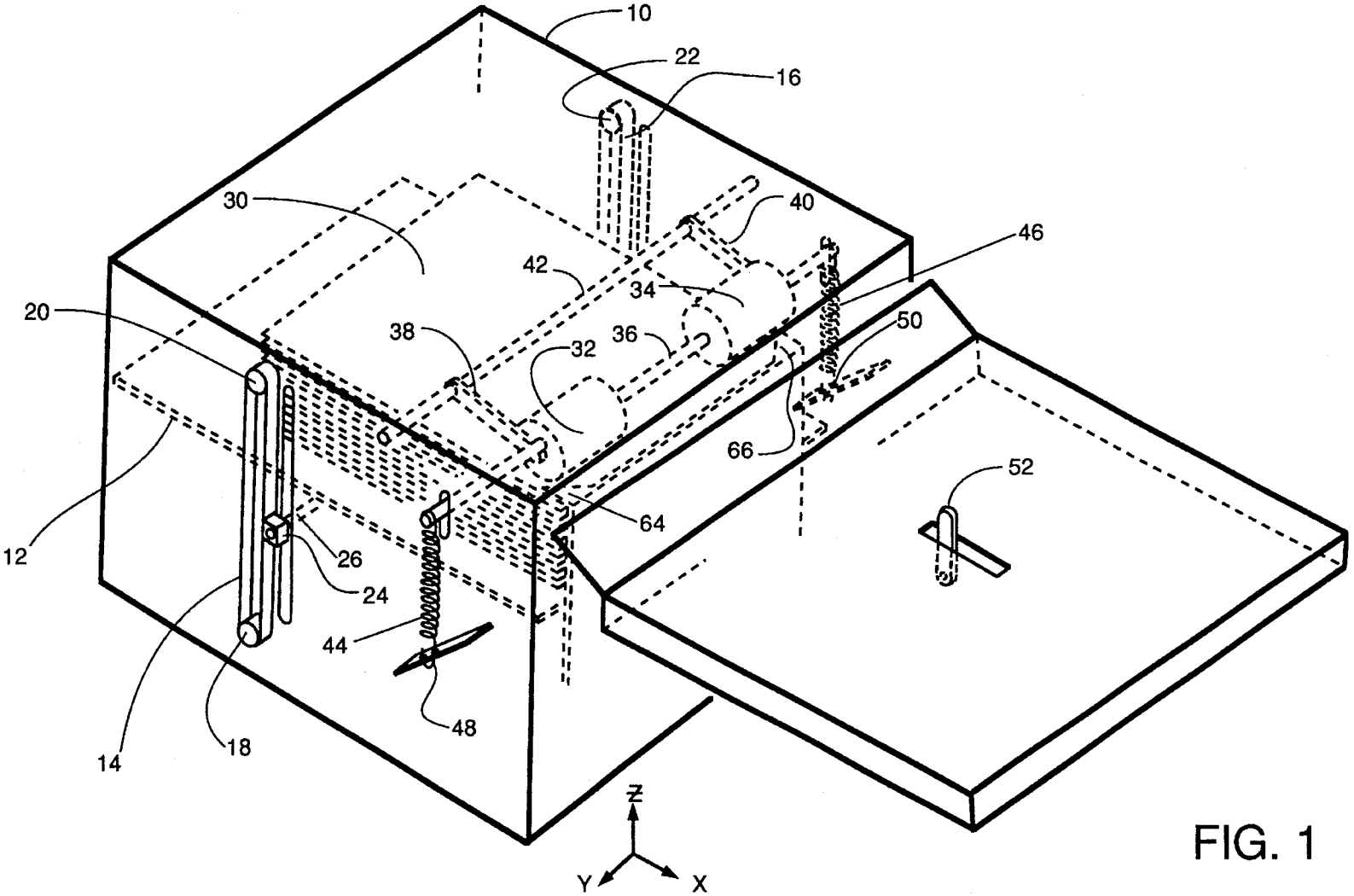
FIG. 1 is a perspective view of a typical sheet feeder in which the invention finds utility.

Referring to FIG. 1, there is shown a perspective view of a sheet feeder according to the teachings of the invention. A sheet magazine 10 in the form of a rectangular enclosure stores multiple sheets of paper for feeding into the laser printer. The sheet magazine has a movable bottom 12 which can be moved up and down under the influence of drive belts 14 and 16. These belts are driven by a stepper motor, not shown, which turns drive pulley 18 and its counterpart on the other side of the magazine. Pulleys 20 and 22 are coupled to drive belts 14 and 16 and rotate freely as idler pulleys. A belt follower 24, and its counterpart on the other side of the sheet feeder, are attached to the drive belts 14 and 16 and move up and down as the belts move in response to rotation of the drive pulleys. The belt follower 24, and its counterpad on the other side, are attached to opposite ends of a rod 26 which is affixed to the underside of the movable floor 12. The movable floor 12 moves up and down in tracks (not shown) under the influence of forces imposed on it by rod 26 in response to movements of the belts 14 and 16.

The stepper motor which drives drive pulley 18, and its counterpart on the other side of the sheet feeder, is under control of a microprocessor (not shown) and a control program stored in ROM or EPROM (also not shown). This electronic circuitry and software will be discussed later herein.

The top sheet of paper 30 is positioned by the movable floor 12 under control of the microprocessor so as to push upward on two input feed rollers 32 and 34. These feed rollers are rotated by a stepper motor (not shown) which drives shaft 36 in a rotary motion. The feed rollers 32 and 34 are affixed to the shaft 36, but shaft 36 is coupled to two pivot arms 38 and 40 by bushings or bearings (not shown). Pivot arms 38 and 40 are affixed to a pivotal shaft 42 which rotates about the long axis of shaft 42 about bearings or bushings (not shown) coupling the ends of shaft 42 to the housing 10. Springs 44 and 46 are coupled between immobile anchor points 48 and 50 and the ends of shaft 36. The purpose of these springs 44 and 46 is to pull downward on shaft 36 so as to cause sheet feeder feed rollers 32 and 34 to exert a downward normal force on the top sheet 30 of the paper stack. The microprocessor and control program control the movements of the belts 14 and 16 such that the movable floor 12 of the sheet feeder is positioned such that the top sheet 30 pushes upward on the feed rollers 32 and 34 sufficiently to stretch springs 44 and 46 a sufficient amount to get the desired normal force F pushing the feed rollers 32 and 34 down in the negative z direction on the top sheet of paper.

The normal force between the feed rollers 32 and 34 and the top sheet 30 determines the amount of force the feed rollers can exert on the top sheet 30 in the positive x direction so as to push the top sheet 30 toward the paper sensor switch 52 and the laser printer (not shown). The normal force also determines how much drag would be exerted on the top sheet 30 as it is drawn into the laser printer by the feed rollers (not shown) of the laser printer if the normal force is not reduced by the operation of the control software and the microprocessor (not shown).

Figure 2:
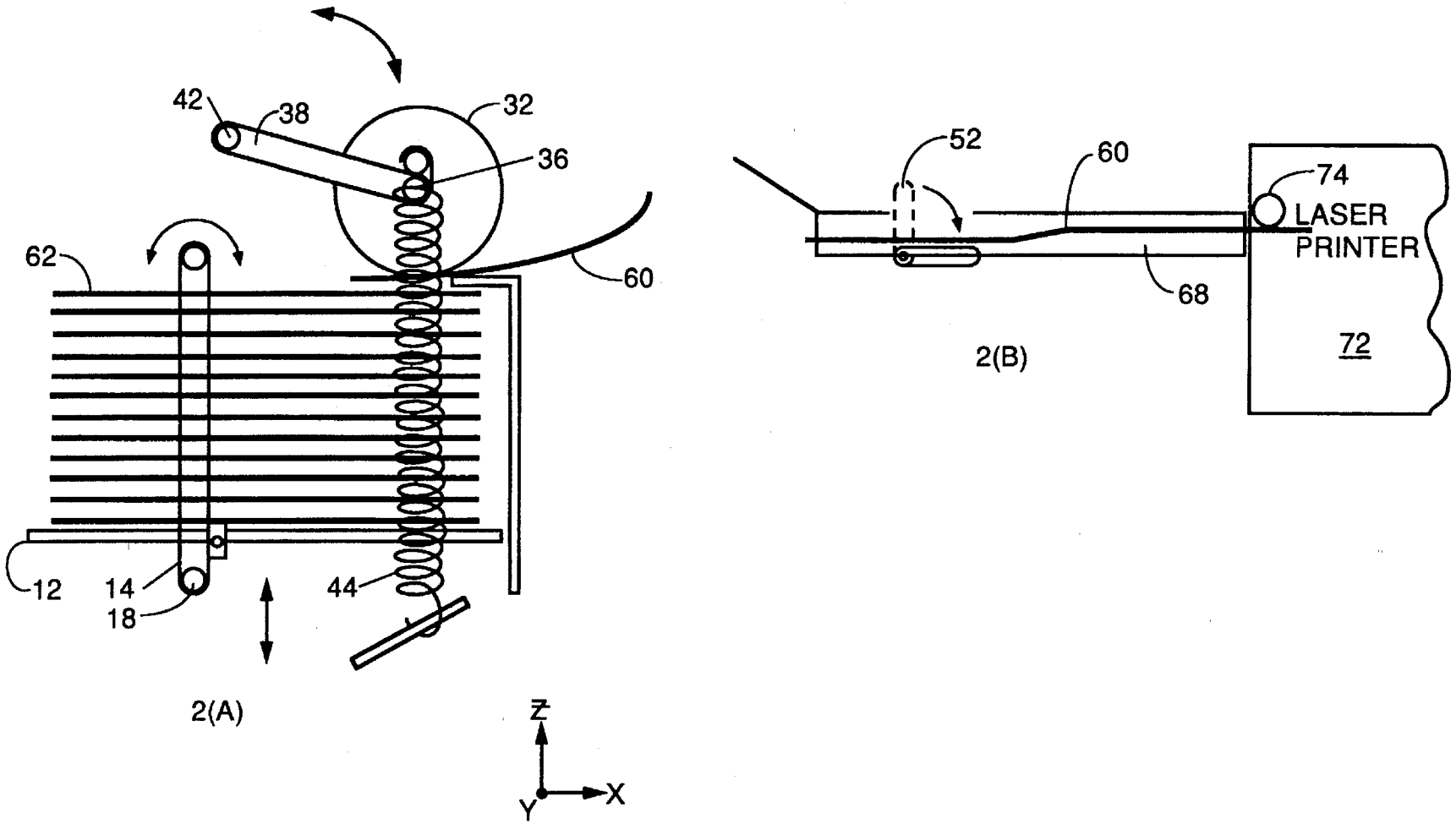
FIG. 2 is an elevation view of the details of the typical feed roller structure of a multiple sheet feeder.

Referring to FIG. 2, comprised of FIGS. 2(A) and 2(B), there is shown in FIG. 2(A) a side view of the sheet feeder magazine and, in FIG. 2(B), a side view of the sheet feeder paper output path. The feed roller 32 of the sheet feeder is made of a rubber compound. The particular type of rubber used is not critical to the invention so long it has a coefficient of friction such that the required forces can be imposed on the top sheet of paper. This rubber input feed roller must have a coefficient of friction which is sufficient when the predetermined normal force is applied downward on the stack to cause a force F acting on the top sheet of paper along the positive X axis which is greater than the forces tending to keep the top sheet 60 in the stack. Obviously many different combinations of coefficients of friction and normal force can be devised which satisfy the above noted criteria. The forces acting on the top sheet 30 are caused by friction between the top sheet 30 and the second sheet 62 in the stack and by forces caused by conventional triangular corner separators 64 and 66 seen in FIG. 1. The force imposed by feed roller 32 pushes the top sheet 30 to the right into the output sheet feed tray 68 shown in FIG. 2(B).

The feed tray 68 has a microswitch 52 coupled thereto in such a manner that when a sheet of paper slides toward the printer, the front edge of the paper eventually engages the microswitch. As the top sheet of paper moves further toward the laser printer 72, the movement of the paper pushes the arm of the microswitch from the vertical position shown in phantom in FIG. 2(B) to the horizontal position shown in solid lines thereby causing the microswitch to change states. The position of the microswitch 52 is such that when its arm has been pushed to the horizontal position, the control microprocessor knows that the top sheet of paper has reached a predetermined point in said paper path close to the feed roller of the laser printer, and will soon be engaged by the input feed roller 74 inside the laser printer. In fact, the control microprocessor of the sheet feeder knows that after microswitch 52 changes states, the sheet 60 will be engaged by the laser printer a predetermined number of steps later in terms of steps of the stepper motor that drives the feed roller 32 in rotation. In alternative embodiments, the fact that the top sheet has reached a predetermined point in the paper path can be signalled by the laser printer. The predetermined point in the paper path may be anywhere. But in embodiments where the laser printer signals the sheet feeder that the top sheet has reached the predetermined point, said point is usually near enough to the input feed roller of the laser printer to make it easy for a sensor in the laser printer to detect the presence of the paper. In such an embodiment, the connection of the control microprocessor is to the signal from the laser printer as opposed to the microswitch 52. The fact that the paper has reached a predetermined position in the paper path may also be signalled by changing the data in a memory cell location in the laser printer in shared memory space which is periodically polled by the sheet feeder microprocessor. When the paper sensor in the laser printer senses that the paper has reached the predetermined point, the laser printer microprocessor writes a logic 1 into the periodically polled memory location.

Figure 4:
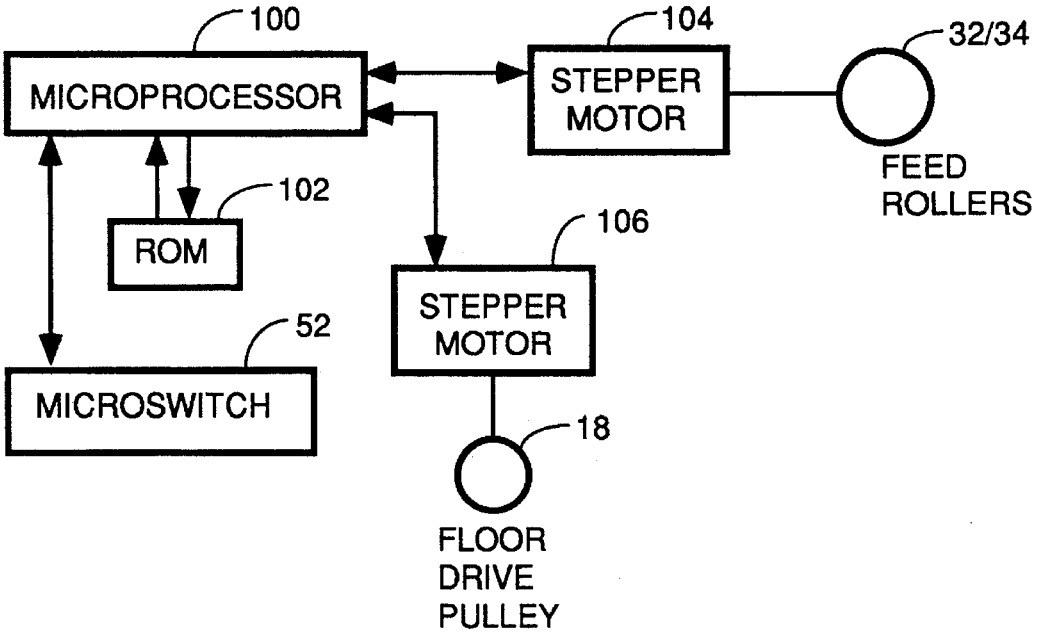
FIG. 4 is a block diagram of a computer system for controlling a sheet feeder for a laser printer according to the teachings of the invention.
Figure 3A:
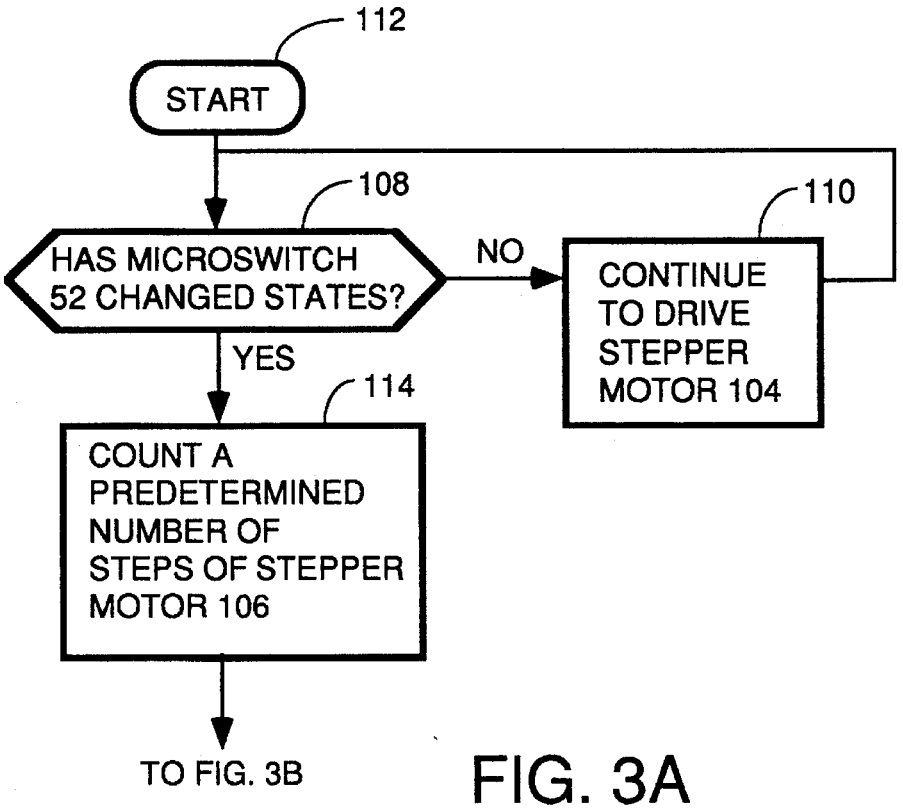
FIG. 3, comprised of FIGS. 3(A) and 3(B), is a flow chart of a control program according to the teachings of the invention which controls the computer system shown in FIG. 4.
Figure 3B:
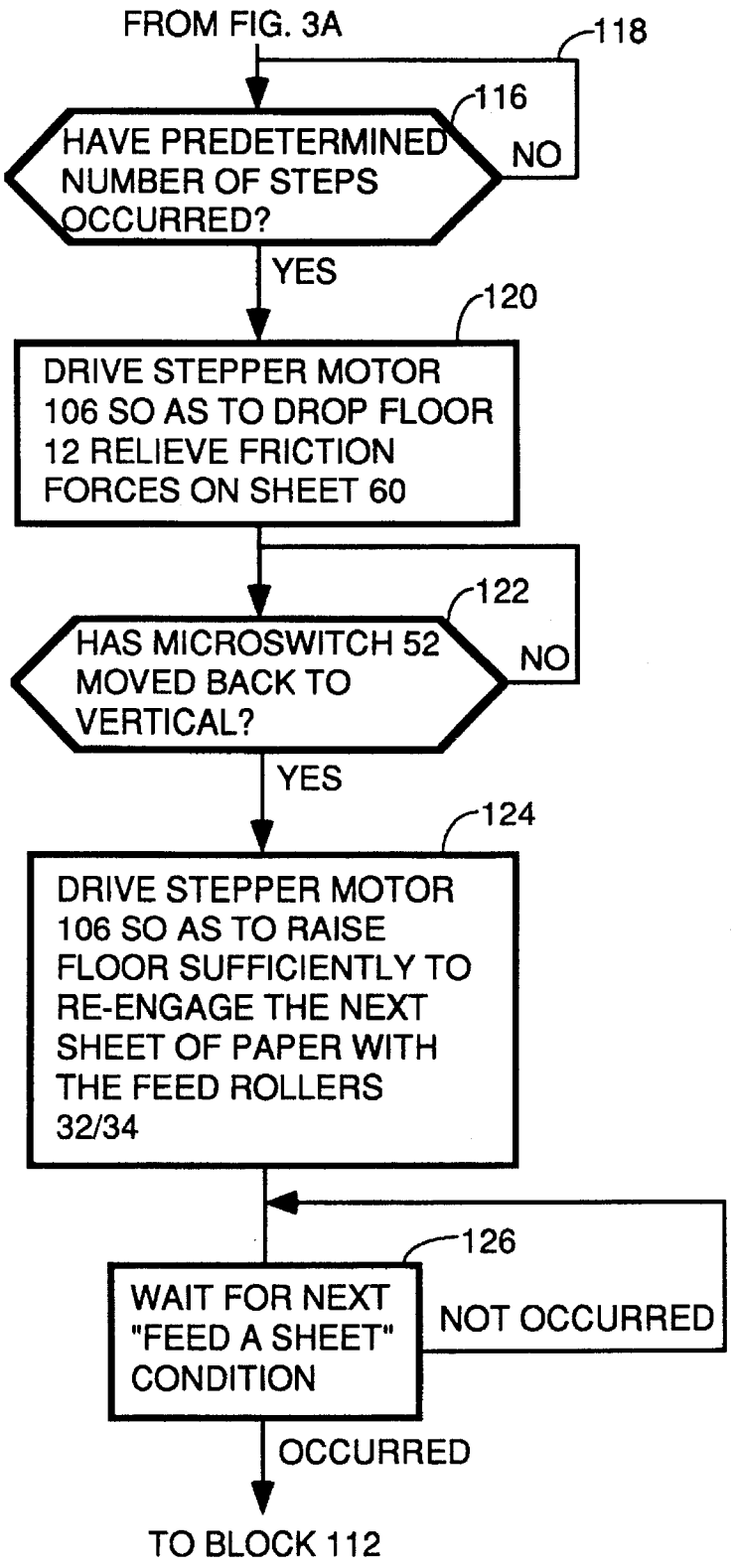

The purpose of the control software in implementing the invention is to sense the change of states of microswitch actuated by arm 52', count a predetermined number of steps of rotation of feed roller 32 and drive the motor which rotates drive pulley 18 in a direction so as to cause floor 12 to move in the negative Z direction. Any software which performs this function or one like it will be within the teachings of the invention. For example, control software which senses the engagement of the sheet of paper 30 with the input feed roller 74 in any way and causes floor 12 to drop slightly will be within the teachings of the invention. Alternatively, the control software could also raise the feed roller to reduce the amount of friction on the paper sheet 30 using suitable motive mechanism and selectively engagement mechanism. In some embodiments, the microprocessor controlling the sheet feeder may be linked to the microprocessor within the laser printer such as by I/O commands, a data bus or shared memory space. In such an embodiment the microprocessor in the laser printer would signal when the sheet of paper 30 was engaged either by: (1) setting a bit in the shared memory space which the microprocessor in the sheet feeder periodically polls, or (2) by sending an I/O command or data byte to the microprocessor in the sheet feeder indicating that sheet of paper 30 has been engaged. When either of these signals is received, the floor 12 is dropped slightly or the feed roller is raised slightly. In another embodiment, the sheet feeder can sense movement of the sheet 30 in any way not caused by the feed roller 32 in the sheet feeder. When movement of the sheet feeder 30 toward the laser printer 72 is sensed, and this movement is not caused by the feed roller 32, the microprocessor of the sheet feeder drops the floor 12 to reduce drag on the sheet 30. The preferred embodiment for the control software is shown in the flow chart of FIG. 3 comprised of FIGS. 3(A) and 3(B). Referring jointly to FIG. 3 and FIG. 4, the preferred operation of the invention is detailed. FIG. 4 is a block diagram of one embodiment for the electronics of the sheet feeder. A control microprocessor 100 executes a control program stored in ROM 102. The microprocessor 100 is coupled to the microswitch actuated by arm 52' and to a stepper motor 104 which drives the sheet feeder feed rollers 32/34. The microprocessor 100 is also coupled to a stepper motor 106 which drives the drive pulley 18 which controls the position of the floor 12.

The flow chart of FIG. 3 is the preferred embodiment of a control program which implements the invention although several other equivalents exist. The process dictated by this control program starts with the start block 112. It is assumed at start block 112 that a "feed the next sheet" state has been reached by any conventional path or means. This can be by receiving a signal from the laser printer, but is preferably the return of the microswitch actuating arm 52' to the vertical position. Next, the test of step 108 is performed. This step determines whether the microswitch actuated by actuator arm 52' has changed states. If it has not, the sheet 30 has not yet travelled far enough. In that event, step 110 is performed to continue to drive the stepper motor 104. After step 110 is performed, processing returns to step 108 to wait for the microswitch 52 to change states. If the test of step 108 determines that the microswitch 52 has changed states, step 114 is performed to count out a predetermined number of steps of stepper motor 106. The purpose of this step is to cause the stepper motor 104 to continue to drive the sheet feeder feed rollers 32/34 enough to drive the sheet 30 into engagement with the feed roller 74 in the laser printer 72. Accordingly, the predetermined number of steps depends upon the relative position of the feed rollers 32/34 and 74, i.e., the length of the paper path, the relative position of microswitch 52 and the amount of paper travel for each step of feed roller 32/34. Step 116 represents the process of testing to see whether the predetermined number of steps has occurred. If not, test 116 is repeatedly performed as symbolized by path 118. If the steps have occurred, step 120 is performed. This step drops the floor 12 sufficiently to relieve friction and drag between top sheet 30 and second sheet 62 and is performed by microprocessor 100 by issuing a command to stepper motor 106 to move a predetermined number of steps to move the floor 12 down a small distance. In alternative embodiments, the feed rollers 32 and 34 and their associated pivot mechanism may be coupled to a feed roller elevation mechanism comprised of a selectively engaged power transfer link driven by a stepper motor, solenoid, pneumatic or hydraulic piston under control of the computer system. In such an embodiment, the bias springs 44 and 46 would apply normal force to the top sheet in the stack as before and the feed roller elevation mechanism would be disengaged from the feed roller pivot mechanism during times before step 120 in FIG. 3(B) is executed. However, when step 120 is to be executed after the sheet of paper has moved along the paper path sufficiently far to engage the feed rollers of the laser printer, the power transfer link would be engaged with the pivot mechanism of the feed rollers 32 and 34 and the computer system would direct the motor, solenoid, pneumatic or hydraulic cylinder to apply power to the feed roller pivot mechanism through the power transfer link to raise the feed rollers out of contact with the top sheet of paper in the stack. Thereafter, step 122 would be performed and step 124 would be performed using the power transfer link and the motive force application means to lower the feed rollers 32 and 34 back into contact with the top sheet in the stack.

Returning to consideration of the preferred embodiment, the test of step 122 is performed after step 120 is complete to determine if the microswitch 52 has moved back to the vertical position indicating the paper sheet 30 has cleared the paper path. If this transition of the microswitch has not occurred, the machine waits. If the transition of the microswitch has occurred, step 124 is performed. This step represents the command to stepper motor 106 to move the floor 12 back up sufficiently to engage sheet 62 with feed rollers 32/34. The floor 12 must also be moved upward sufficiently to stretch springs 44 and 46 in FIG. 1 enough to cause an adequate amount of normal force pushing down on sheet 62. The normal force must be sufficient that the feed rollers 32/34 can exert enough force on sheet 62 in the positive X direction to overcome the forces tending to keep this sheet in the stack. Finally, step 126 is performed to wait for the next feed a sheet condition, at which time processing vectors to block 112.

Although the invention has been described in terms of the preferred and alternative embodiments disclosed herein, those skilled in the art will appreciate various substitutions which may be made for various elements in the disclosed embodiments which do not alter the basic functionality of each element and the functional interaction between the elements. In addition, certain other modifications may also be appreciated which do not alter the basic principle of operation and the interplay and functional interdependency of the combined elements. All such modifications and substitutions are within the scope of equivalents under the doctrine of equivalents and 35 U.S.C. Section 112, Paragraph 6 claim interpretation of means plus function claims appended hereto.

What is claimed is:

1. An apparatus for reducing the drag on the feed roller of a host device in drawing a sheet of paper in from a sheet feeder, comprising:

a sheet feeder having a spring loaded feed roller that bears down on the top sheet of a stack of paper in a magazine within said sheet feeder under the influence of one or more bias springs, said feed roller being rotatable under the influence of a first drive motor, said magazine having a movable floor that moves up toward said feed roller or down away from said feed roller under the control of a second drive motor, said sheet feeder having an output paper path which receives a paper sheet pulled off the top of said stack by said feed roller, said paper sheet travelling along said paper path toward a host device input port and an associated host device feed roller, and having means for sensing when said sheet of paper reaches a selected point in said paper path from said sheet feeder to the paper input pod of said laser printer;

a computer system coupled to said first and second drive motors and to said means for sensing, for controlling said sheet feeder, said computer system under the control of a control program comprising means for causing said computer system to drive said first drive motor so as to rotate said feed roller of said sheet feeder in such a manner to pull the top sheet of said stack away from said stack and into said paper path when a new sheet is to be fed into said host device and to continue to push said sheet of paper into said paper path;

means for continuing to control said computer system to drive said sheet feeder feed roller so as to move said sheet of paper in said paper path toward said host device while monitoring said means for sensing for an indication that the paper has reached a predetermined point in said paper path;

means for controlling said computer system so as to continue to drive said first drive motor in such a way to rotate said sheet feeder feed roller so as to move said paper toward said host device a predetermined distance sufficient to engage said sheet of paper with said feed roller in said host device after said means for sensing indicates said paper has reached said predetermined point in said paper path; and means for controlling said computer system so as to drive said second drive motor in such a way to move said movable floor away from said sheet feeder feed roller a sufficient distance to substantially eliminate friction between said feed roller of said sheet feeder and said sheet of paper which has been engaged by said feed roller in said host device.

2. The apparatus of claim 1 wherein said means for sensing when said sheet of paper has reached said predetermined position is a microswitch having an arm located in said paper path so as to be deflected to a position to cause a change of state of said microswitch when said sheet of paper reaches said predetermined position and which springs back to the original position when said sheet of paper has cleared the paper path.

3. The apparatus of claim 2 wherein said control program further comprises:

means for monitoring said microswitch for a change of states which occurs after said sheet of paper which has been pushed into engagement with said feed roller of said host device has been drawn far enough into said host device to clear the paper path sufficiently so as to disengage with said arm on said microswitch thereby allowing said spring loaded arm to move back to a first state in which said arm resided before being engaged by the edge of said sheet of paper as it moved toward said host device;

means for controlling said computer system so as to drive said second drive motor in such a way as to push said movable floor back toward said feed roller of said sheet feeder sufficiently to engage said feed roller with the top sheet of paper in said stack and compress said bias springs sufficiently so that a normal force is exerted downward on said stack by said feed roller which is sufficient, given the type of material used in said feed roller of said sheet feeder, such that the frictional forces exerted by said feed roller on said top sheet as said feed roller rotates exceed the forces tending to keep said top sheet in said stack of paper.

4. A process for feeding sheets of paper from a sheet feeder having multiple sheets of paper stored therein into a host device so as to reduce wear on an input feed roller of said host device, comprising the steps of:

sensing with a computer controlled system when a sheet of paper has moved to a predetermined point on a paper path between said sheet feeder and said host device;

when said predetermined point is reached, driving a paper moving mechanism in said sheet feeder with said computer controlled system so as to drive said sheet of paper a predetermined distance further, said predetermined distance being sufficient to engage said sheet of paper with said feed roller of said host device; and when said sheet of paper has engaged said feed roller of said host device, either moving a movable floor of said sheet feeder away from the feed roller of said sheet feeder or moving the feed roller of said sheet feeder away from said movable floor with a computer controlled system sufficiently so as to substantially eliminate friction between said feed roller of said sheet feeder and said sheet of paper which has been engaged by the feed rollers of said host device and which is being drawn into said host device thereby.

5. The process of claim 4 further comprising the steps of:

monitoring movement of the sheet of paper being drawn into the host device by the feed roller of said host device with a computer controlled system to determine a point in time when the act of paper feeding is complete and said sheet of paper fed into said host device has moved far enough into the host device to be out of engagement with said feed roller of said sheet feeder if said movable floor of the sheet feeder was moved back up toward said feed roller of said sheet feeder sufficiently to move the feed roller into contact with said stack of papers or if said sheet feeder feed roller was lowered toward said movable floor sufficiently to bring it into contact with the top sheet of paper in said stack of papers;

after said point of time marking feed completion is reached and at or before the point in time when the next sheet of paper in said stack is to be fed into said host device, either raising said movable floor toward said feed roller or lowering said feed roller toward said movable floor sufficiently to re-engage said feed rollers of said sheet feeder with the new top sheet of said stack of papers with sufficient normal force such that when said feed roller of said sheet feeder is rotated, the forces imposed on said new top sheet of paper by said feed roller of said sheet feeder tending to move said new top sheet out of said stack exceed the forces acting on said new top sheet tending to keep the new top sheet of paper in said stack.

6. A process for feeding sheets of paper from a sheet feeder having multiple sheets of paper stored therein into a host device having an input feed roller tasked with pulling sheets of paper or other media into said host device, said process for reducing wear on an input feed roller of said host device, comprising the steps of:

sensing with a computer controlled system when a sheet of paper has moved to a predetermined point on a paper path between said sheet feeder and said host device so as to be engaged with said input feed roller of said host device; and when said sheet of paper has engaged said feed roller of said host device, either moving a movable floor of said sheet feeder away from the feed roller of said sheet feeder or moving the feed roller of said sheet feeder away from said movable floor with a computer controlled system sufficiently so as to substantially eliminate friction between said feed roller of said sheet feeder and said sheet of paper or other media which has been engaged by the feed rollers of said host device and which is being drawn into said host device thereby.

7. The process of claim 6 further comprising the steps of:

monitoring movement of the sheet of paper being drawn into the host device by the feed roller of said host device with a computer controlled system to determine a point in time when the act of paper feeding is complete and said sheet of paper fed into said host device has moved far enough into the host device to be out of engagement with said feed roller of said sheet feeder if said movable floor of the sheet feeder was moved back up toward said feed roller of said sheet feeder sufficiently to move the feed roller into contact with said stack of papers or if said sheet feeder feed roller was lowered toward said movable floor sufficiently to bring it into contact with the top sheet of paper in said stack of papers;

after said point of time marking feed completion is reached and at or before the point in time when the next sheet of paper in said stack is to be fed into said host device, either raising said movable floor toward said feed roller or lowering said feed roller toward said movable floor sufficiently to re-engage said feed rollers of said sheet feeder with the new top sheet of said stack of papers with sufficient normal force such that when said feed roller of said sheet feeder is rotated, the forces imposed on said new top sheet of paper by said feed roller of said sheet feeder tending to move said new top sheet out of said stack exceed the forces acting on said new top sheet tending to keep the new top sheet of paper in said stack.

* * * * *